United States Patent [19]

Chou

[11] Patent Number: 4,925,470

[45] Date of Patent: May 15, 1990

[54] BOTTOM EJECTION TYPE INSTANT COOLING EASY-OPENER WITH AMUSEMENT EFFECT

[76] Inventor: Tien-Fa Chou, No. 117, San Dien Lane, Shui Li Hsiang, Nan Tou Hsien, Taiwan

[21] Appl. No.: 337,973

[22] Filed: Apr. 14, 1989

[51] Int. Cl.[5] ..... F25D 5/00

[52] U.S. Cl. ..... 62/4; 62/125; 62/294

[58] Field of Search ..... 62/4, 125, 294

[56] References Cited

U.S. PATENT DOCUMENTS

| | | | |
|---|---|---|---|
| 1,897,723 | 2/1933 | Free | 62/294 |
| 3,373,581 | 3/1968 | Strader | 62/294 |
| 3,636,726 | 1/1972 | Rosenfeld et al. | 62/294 |
| 3,970,068 | 7/1976 | Sato | 62/294 X |
| 4,584,848 | 4/1986 | Barnett | 62/294 |
| 4,679,407 | 7/1987 | Kim et al. | 62/294 |
| 4,784,678 | 11/1988 | Rudick et al. | 62/4 |
| 4,802,343 | 2/1989 | Rudick et al. | 62/4 X |

*Primary Examiner*—Lloyd L. King

*Attorney, Agent, or Firm*—Varndell Legal Group

[57] ABSTRACT

This invention relates to a bottom ejection type instant cooling easy-opener which can be instantly cooled down while producing a colorful gas and a whistling sound effect, wherein the easy-opener is having a circular convex (concave) seat made on the inner bottom and fixedly connected with one layer of adhesive material, a cylindrical cooler, a resilient sealing element and a metal plate; a metal injection needle having a rubber adapter connected at one end for further connection with a straw, and a whistle means set at the bottom of the circular convex (concave) seat, and wherein said metal injection needle is used to pierce through said resilient sealing element to let the instant cooling agent of the cylindrical cooler be exhausted to instantly cool down the easy-opener and to concomitantly produce a colorful gas and a whistling sound. To let the instant cooling agent be vaporized to exhaust from the stepped cylindrical cooler through the capillary holes of the metal plate to pass through the chamber of resonance of the upper and lower whistle elements so as to provide a whistle.

5 Claims, 7 Drawing Sheets

BOTTOM EJECTION TYPE INSTANT COOLING EASY-OPENER WITH AMUSEMENT EFFECT

BACKGROUND AND SUMMARY OF THE INVENTION

The present invention is related to a kin of easy-opener and, more particularly to a bottom ejection type instant cooling easy-opener with amusement effect, which can be instantly cooled down while producing a colorful gas and a whistling sound effect.

Easy-opener beverages are favorably accepted by the consumers everywhere in the world because of its advantages of being convenient to carry and easy to open. By pulling up the pull-up ring, an easy-opener beverage is instantly ready for service. More particularly during hot summer season, it is very fantastic to drink a refrigerated beverage. However, an easy opener beverage still can not fully satisfy consumers' requirements because of the reasons as described hereunder.

(1) When one is carrying easy-opener beverages with oneself to go for recreational activities or mountaineering, drinkers can not enjoy a cooling drinking, and the beverages may be unable to provide best taste or to quench one's thirst.

(2) If there is no cooler available or during power failure, an easy-opener beverage can not be prepared as a cooling drink for service to quench one's thirst during hot summer season.

The main object of the present invention is to provide a bottom ejection type instant cooling easy-opener with amusement effect, wherein a cylindrical cooler is connected with a metal plate and a resilient sealing element and fixedly set in a circular seat made on the bottom cover of the easy-opener, and wherein a metal injection needle is provided to pierce through the resilient sealing element to let the inner instant cooling agent be exhausted from the cylindrical cooler to eject through the needle so as to instantly cool down the easy-opener.

Another object of the present invention is to provide a bottom ejection type instant cooling easy-opener with amusement effect, wherein the instant cooling agent contained in the cylindrical cooler is mixed with pigment additives so as to provide a colorful gas during cooling process.

A yet further object of the present invention is to provide a bottom ejection type instant cooling easy-opener with amusement effect, wherein a whistle means is set at the bottom of the circular seat so as to provide a whistling sound effect during cooling process.

The above-described and other objects of this invention will be more apparent from the following description quoted on the basis of annexed drawings as hereunder.

DETAILED DESCRIPTION OF THE PREFERRED EMBODIMENTS

Figure 1:
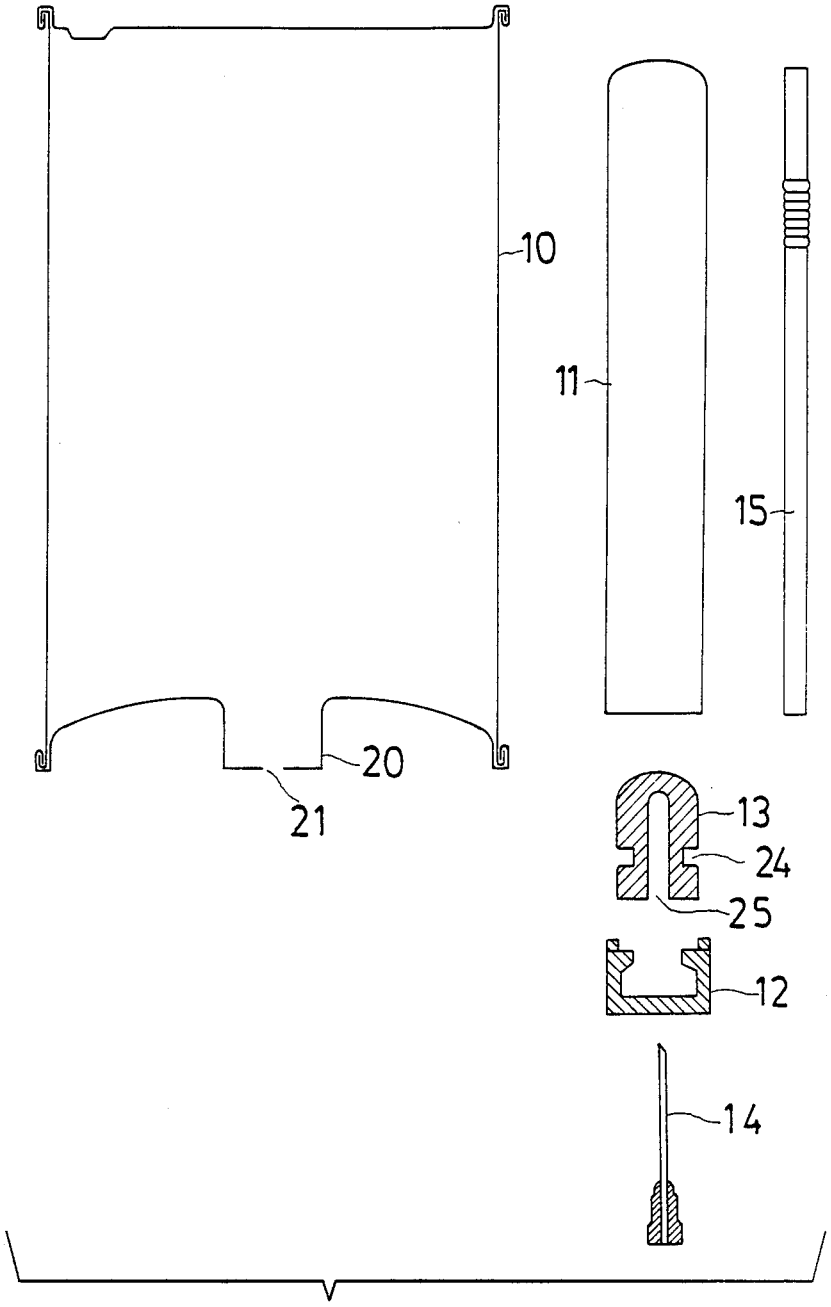
FIG. 1 is a structural fragmentary view of the present invention.
Figure 2:
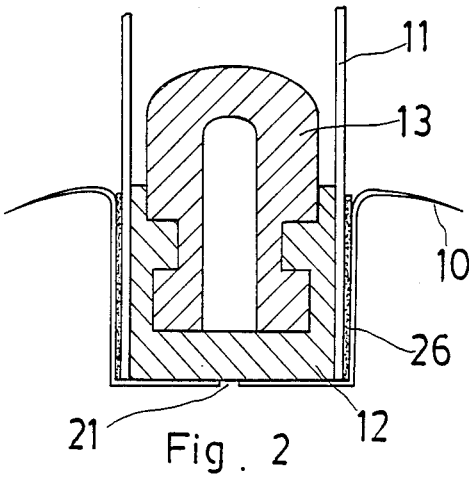
FIG. 2 is a partly assembly view drawing of the present invention.
Figure 3:
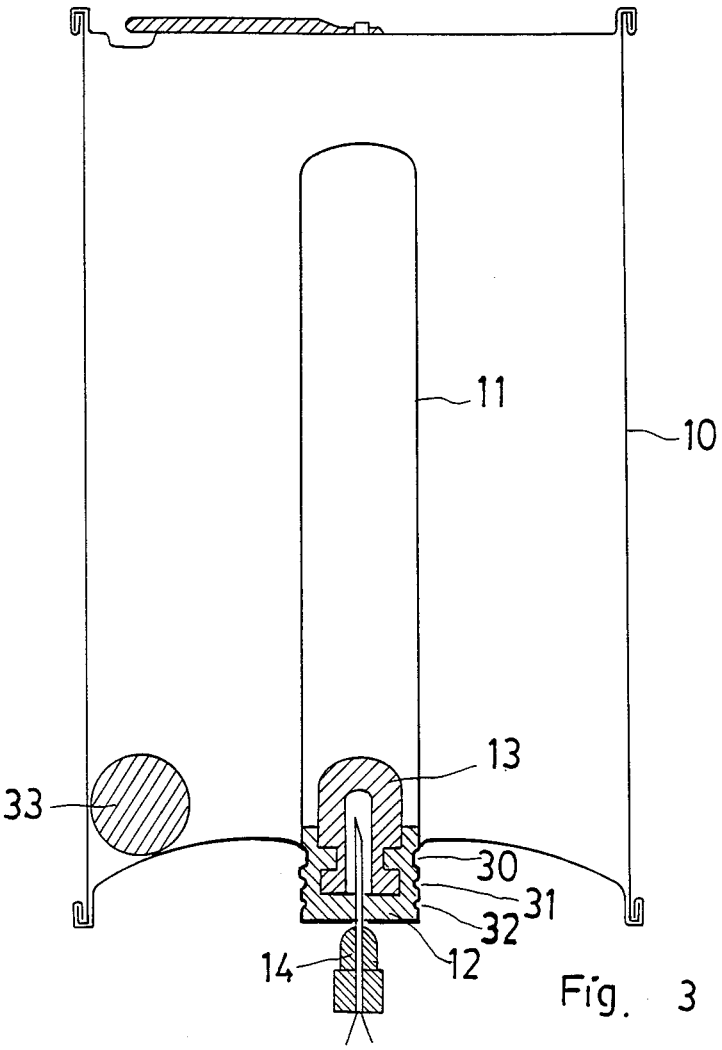
FIG. 3 is a schematic assembly view drawing of the present invention.
Figure 4:
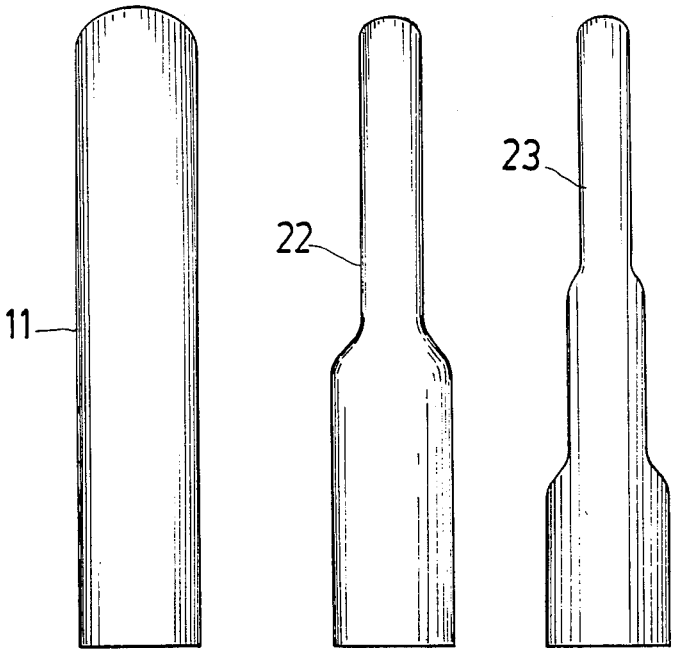
FIG. 4 illustrates several cylindrical coolers for use in the present invention.
Figure 5:
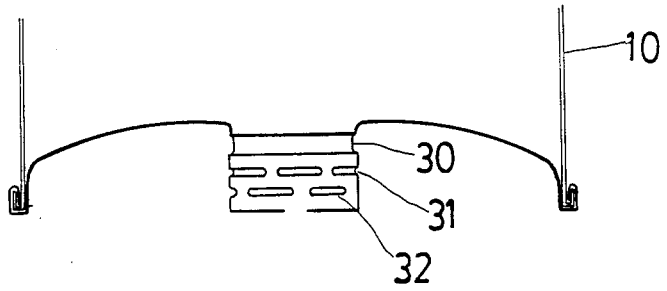
FIG. 5 is a schematic drawing, illustrating a process to make circular grooves on the circular concave (convex) seat so as to let the inner component parts be firmly connected with the seat.

Referring to FIGS. 1 through 5, an easy-opener 10 is including a circular concave seat 20 made at the inner bottom at the center for setting therein of a cylindrical cooler, wherein the circular concave seat 20 comprises a center hole 21 arranged in 1–3 m/m wide. There is provided a cylindrical cooler 11, which may be arranged in a configuration of simple cylinder 11, or stepped cylinder 22 or multi-stepped cylinder 23, containing thereinside a kind of instant cooling agent, which may be a liquid or gaseous $CO_2$ or $N_2$ or CFC and mixed with pigment additives. The cylindrical cooler 11 is comprising a resilient sealing element 12 and a metal plate 13 respectively set at the bottom. The metal plate 13 which may be made of copper, aluminum or stainless steel particle powder by means of shape forming process to provide capillary action is having a retainer groove 24 made on the outer wall surface, a hollow inner space communicated with its bottom opening 25. When the metal plate 13 is tightly connected with the resilient sealing element 12, the inner portion forms into a vacuum space. When the metal plate 13 and the resilient sealing element 12 are fixedly attached to the bottom end of the cylindrical cooler 11, the cooler 11 is then firmly set in the circular concave seat 20 and coated with one layer of non-toxic and dry type adhesive material 26 to fully seal the connection as shown in FIG. 2. When the cylindrical cooler 11, the metal plate 13 and the resilient sealing element 12 are respectively set in the concave seat 20, the circular concave seat 20 is then processed to provide a first circular groove 30 set at the upper part, a second and interrupted circular groove 31 set at the middle part, and a third and interrupted circular groove 32 set at the lower part, so as to let the circular concave seat 20, the adhesive material 26, the cylindrical cooler 11, the sealing element 12, and the metal plate 13 be firmly retained together. After assembly, the bottom opening 21 of the circular concave seat 20 is covered by means of a label.

There is also provided a metal injection needle 14 comprising a rubber adapter 27 set at one end for connection with a straw 15. According to the present invention, an easy-opener may be comprised of three parts (an upper can part, cylindrical part, and bottom cover), or two parts (an upper cap part, and a body integrally comprised of cylindrical part and bottom cover), with a cylindrical cooler 11 set thereinside and fixedly connected with the bottom cover, to let the beverage contained therein be separated from the instant cooling agent by the casing of the cylindrical cooler 11.

When to drink, use the metal needle 14 to pierce from the opening 21 through the resilient sealing element 12 into the inner hollow space of the metal plate 13 to let the gaseous instant cooling agent be exhausted from the cylindrical cooler 11 through the capillary holes of the metal plate 13 and the hollow metal needle 14 to eject outward, so as to instantly cool down the beverage for service.

According to the present invention, the instant cooling agent contained in the cylindrical cooler 11 may be mixed with pigment additives, such that a color gas will be ejected during the process to pierce through the resilient sealing element 12, so as to provide an amusement effect.

Further, an non-toxic glass ball 33 may be set in the easy-opener 10, which has a size bigger than the top opening made on the upper cover cap of the easy-opener, and is served as a stirring means to stir the beverage so as to provide best cooling effect.

Figure 6:
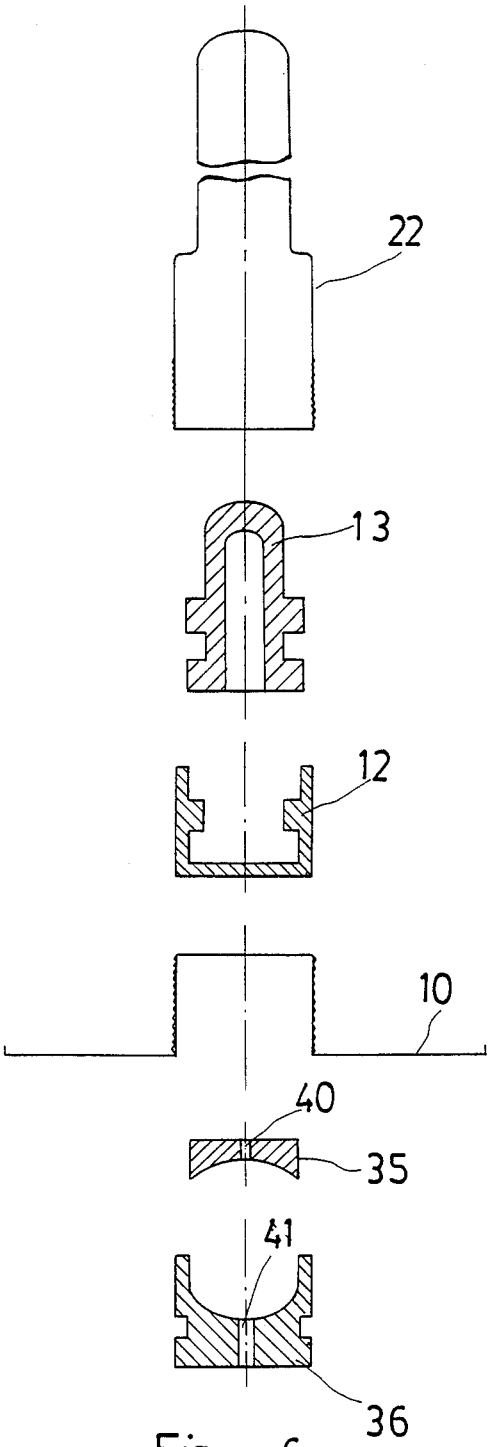
FIG. 6 is a schematic fragmentary view of another embodiment of the present invention, which includes a whistle means comprised of an upper and a lower whistle elements.
Figure 7:
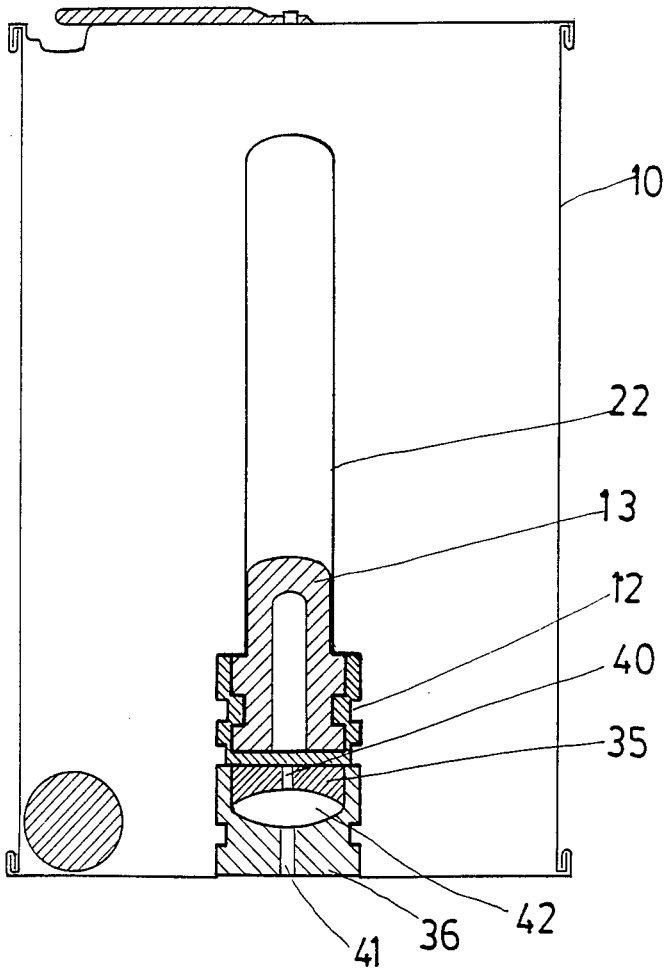
FIG. 7 is a schematic assembly view drawing of the embodiment of FIG. 6.

Referring to FIGS. 6 and 7, another embodiment of the present invention is designed to provide a sound of whistle during cooling process. In this embodiment, the easy-opener 10 is having a circular convex seat 34 made on the inner bottom, which convex seat 34, same as the above-described first embodiment, is fixedly connected with one layer of adhesive material 26, a stepped cylindrical cooler 22, a resilient sealing element 12 and a metal plate 13 respectively at the top, and a whistle means set at the bottom, wherein the whistle means is comprised of an upper whistle element 35 and a lower whistle element 36 to define a chamber of resonance 42 therebetween, and the upper and lower whistle elements 35 and 36 are having holes 40 and 41 respectively made at the middle part for passing therethrough of an ejection needle 14. When in use, take the ejection needle 14 to pierce from the bottom opening 21 through the resilient sealing element 12 via the holes 40 and 41 and then, pull out the needle 14 to let the instant cooling agent be vaporized to exhaust from the stepped cylindrical cooler 22 through the capillary holes of the medal plate 13 to pass through the chamber of resonance 42 of the upper and lower whistle elements 35 and 36 so as to provide a whistle.

Figure 8:
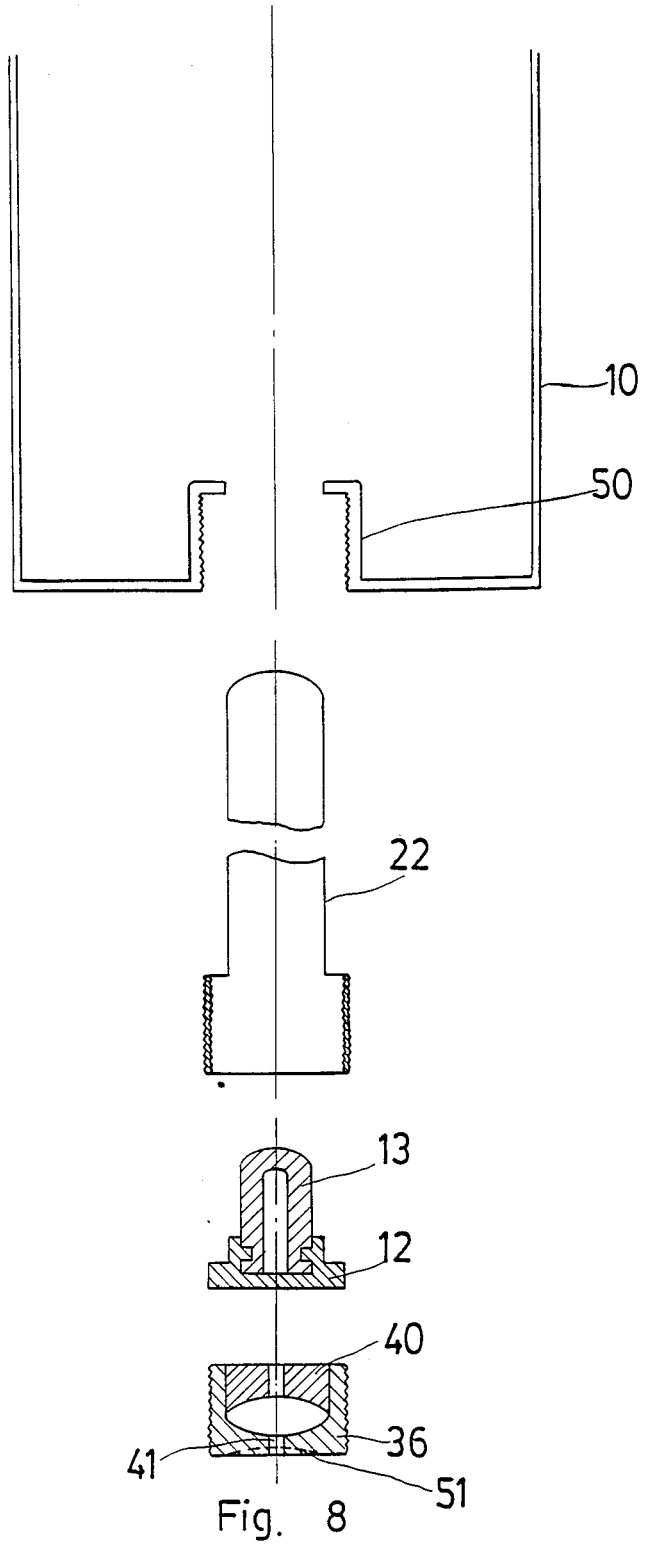
FIG. 8 is a structural fragmentary view of another embodiment of the present invention wherein the cylindrical cooler is connected with the convex seat by means of screw joint.
Figure 9:
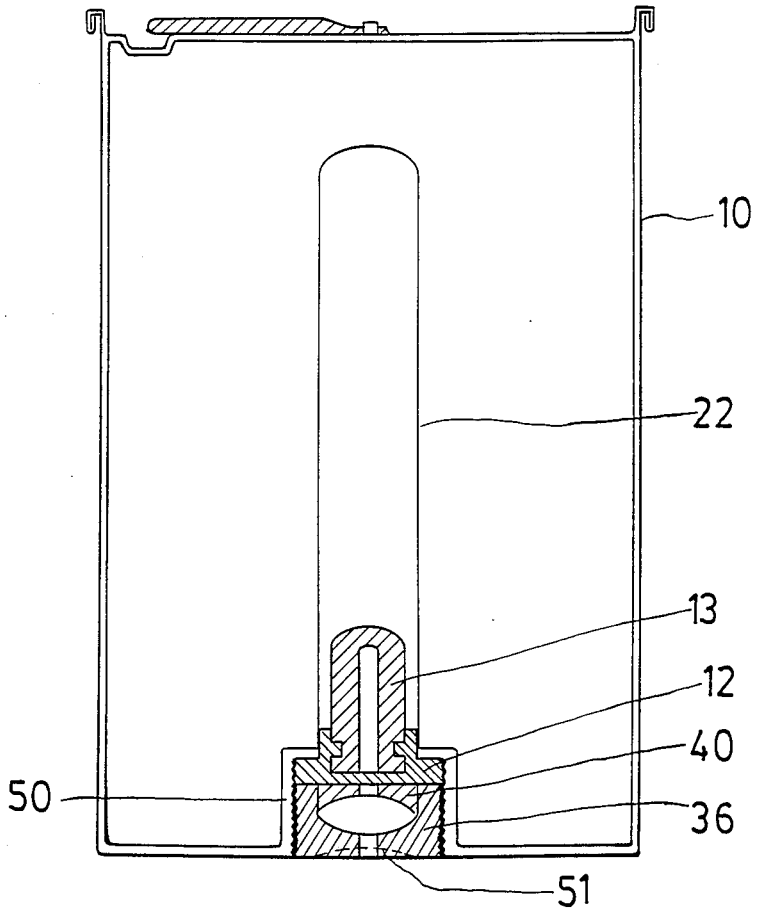
FIG. 9 is a schematic assembly view of the embodiment of FIG. 8.

Please refer to a further embodiment of the present invention as shown in FIGS. 8 and 9. In this embodiment, the easy-opener 10 (or PET bottle container) is comprised of a convex seat 50 integrally made at the bottom through shape-forming process, which is having an inner thread and comprising a round hole set at the center; a stepped cylindrical cooler 22, which is having an inner thread and an outer thread respectively made at the opening end; an upper whistle element 35, which is having an outer thread and a central air hole; a lower whistle element 36, which is having a crossed groove 51 with the center point of the crossed groove 51 served as an air hole; a metal plate 13; and a resilient sealing element 12, wherein the upper whistle element 35 and the lower whistle element 36, and the metal plate 13 and the resilient sealing element are respectively connected by means of slip joint; the bottom end of the stepped cylindrical cooler 22 is set in the central round hole of the convex seat 50 with its inner thread screwed up with the outer thread of the lower whistle element 36 and with its outer thread screwed up with the inner thread of the convex seat 50, and wherein a non-toxic adhesive material is coated over the connecting area among the said component parts to provide air-tight effect.

I claim:

1. A bottom ejection type instant cooling easy-opener with amusement effect, including a circular concave seat made at the inner bottom at the center with a center hole made thereon and arranged in 1–3 m/m wide; a cylindrical cooler containing thereinside a kind of instant cooling agent, and comprising a resilient sealing element set at the bottom opening; a metal plate being be made of copper, aluminum or stainless steel particle powder by means of shape forming process to provide capillary action and having a retainer groove made on its outer wall surface, a hollow inner space, thereinside to communicate with its opening; and a metal injection needle comprising a rubber adapter set at one end for connection with a straw; wherein when said metal plate and said resilient sealing element are fixedly attached to the bottom end of said cylindrical cooler, said cooler is then firmly set in said circular concave seat and coated with one layer of non-toxic and dry type adhesive material to fully seal the connection, and wherein when said cylindrical cooler, said metal plate and said resilient sealing element are respectively set in said concave seat, and said circular concave seat is then processed to provide a first circular groove set at the upper part, a second and interrupted circular groove set at the middle part, and a third and interrupted circular groove set at the lower part, so as to let said circular concave seat, said adhesive material, said cylindrical cooler, said sealing element, and said metal plate be firmly retained together; and wherein said metal injection needle is used to pierce from said opening of said circular concave seat through said resilient sealing element into said inner space of said metal plate to let said instant cooling agent be vaporized to exhaust from said cylindrical cooler through said metal injection needle to the atmosphere to cool down the easy-opener.

2. A bottom ejection type instant cooling easy-opener with amusement effect according to claim 1, wherein said cylindrical cooler is arranged in a cylindrical or stepped cylindrical or multi-stepped cylindrical shape, and said instant cooling agent is preferably a liquid or gaseous $CO_2$, $N_2$ or CFC mixed with pigment additives.

3. A bottom ejection type instant cooling easy-opener with amusement effect according to claim 1, wherein a glass ball is set in the easy-opener, which glass ball has a size bigger than the top opening made on the upper cover cap of the easy-opener, and is served as a stirring means to stir the beverage so as to provide best cooling effect.

4. A bottom ejection type instant cooling easy-opener with amusement effect including a circular convex seat made on the inner bottom and fixedly connected with one layer of adhesive material, a stepped cylindrical cooler, a resilient sealing element and a metal plate respectively at the top, and a whistle means set at the bottom, wherein said whistle element and a lower whistle element to define a chamber of resonance therebetween, said upper and lower whistle elements comprising a hole respectively made at the middle part for passing therethrough of an ejection needle to pierce through said resilient sealing element so as to provide a whistling sound while performing cooling process.

5. A bottom ejection type instant cooling easy-opener with amusement effect according to claim 4, wherein said convex seat is having an inner thread and a central round hole, said stepped cylindrical cooler having an inner thread and an outer thread respectively made at the bottom opening end, said upper whistle element having an outer thread and a central air hole, said lower whistle element having a crossed groove for convenient operation therethrough to screw up with said stepped cylindrical cooler, and wherein the bottom opening end of said stepped cylindrical cooler is set in the central round hole of said convex seat with its inner thread screwed up with the outer thread of said lower whistle element and with its outer thread screwed up with the inner thread of said convex seat, and wherein a non-toxic adhesive material is coated over the connecting area among the said component parts to provide air-tight effect.

* * * * *